United States Patent [19]

Hittel et al.

[11] 4,437,323

[45] Mar. 20, 1984

[54] WARP KNITTING MACHINE WITH WEFT INSERTION MAGAZINE AND SUBSTRATE PROVISION ARRANGEMENT

[75] Inventors: Gerhard Hittel, Rodgau; Hubertus Mühl, Heusenstamm; Franz Eigl, Obertshausen; Werner Langer, Heusenstamm, all of Fed. Rep. of Germany

[73] Assignee: Karl Mayer Textilmaschinen fabrik GmbH, Obertshausen, Fed. Rep. of Germany

[21] Appl. No.: 427,125

[22] Filed: Sep. 29, 1982

[30] Foreign Application Priority Data

Oct. 12, 1981 [DE] Fed. Rep. of Germany ..... 3140480

[51] Int. Cl.[3] ..... D04B 23/06

[52] U.S. Cl. ..... 66/84 A

[58] Field of Search ..... 66/84 A, 85

[56] References Cited

U.S. PATENT DOCUMENTS

| | | | |
|---|---|---|---|
| 3,774,414 | 11/1973 | Vogel | 66/84 A |
| 4,255,947 | 3/1981 | Kohl | 66/84 A |
| 4,347,718 | 9/1982 | Haverland et al. | 66/84 A |
| 4,348,876 | 9/1982 | Roth | 66/84 |

*Primary Examiner*—Ronald Feldbaum

*Attorney, Agent, or Firm*—Omri M. Behr

[57] ABSTRACT

A warp knitting machine has a weft thread magazine, a substrate providing arrangement and at least one barrier element, preferably a holding down means, on the side of the substrate path opposite the needle bar. The weft thread path runs on the side of the substrate path opposite the side facing the needle bar. There is provided at least one forwarding arrangement which by protruding into the weft thread path separates each first weft thread from the one following and transports the former to the rearward side of the needles. The barrier element has an aperture for the passage therethrough for each forwarding arrangement.

11 Claims, 7 Drawing Figures

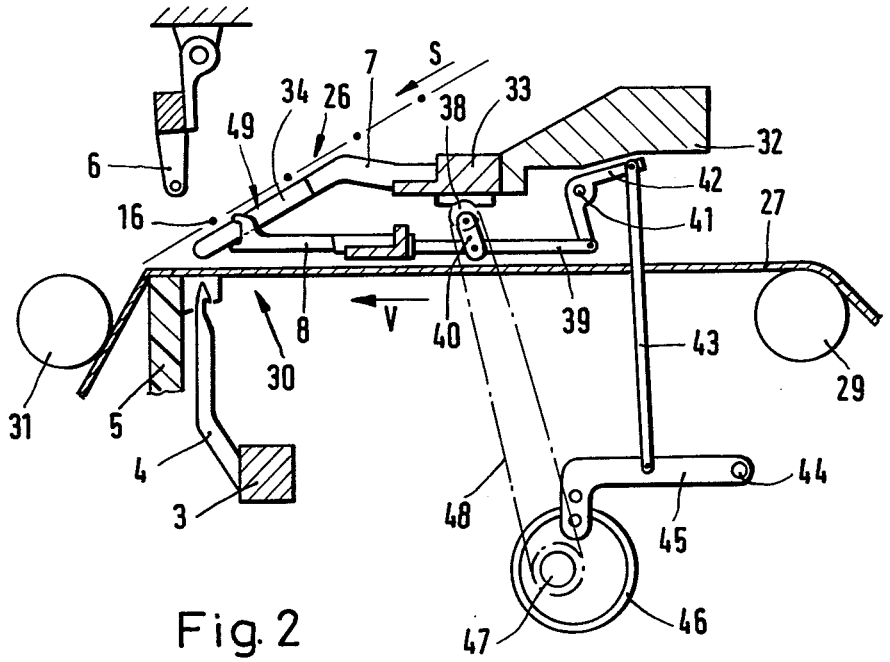
Fig. 2
Fig. 3
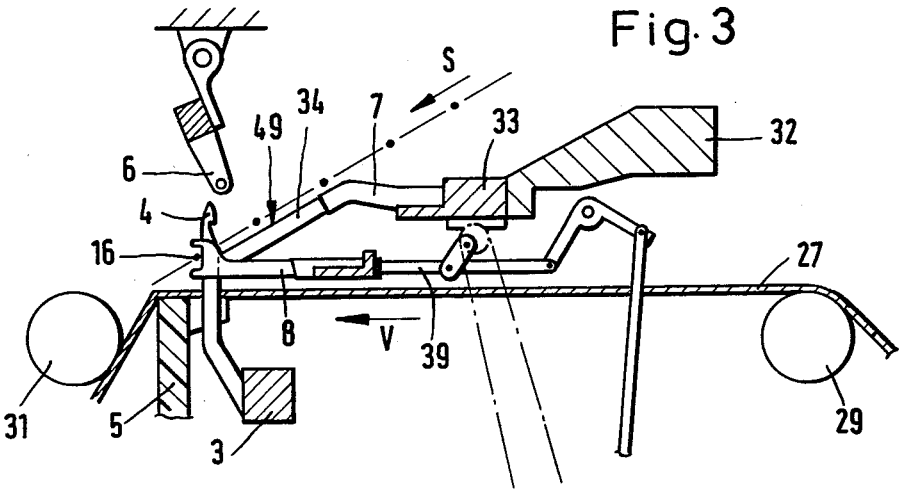

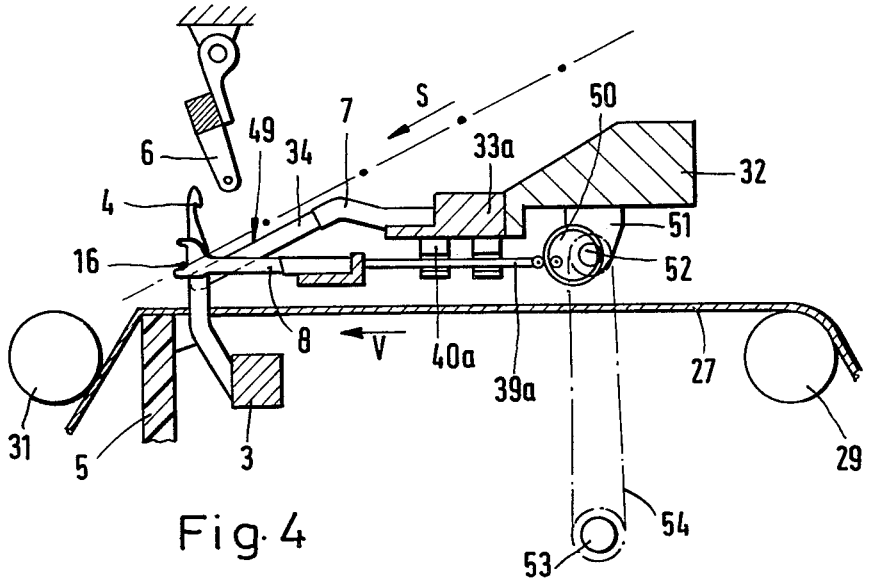
Fig. 4
Fig. 6
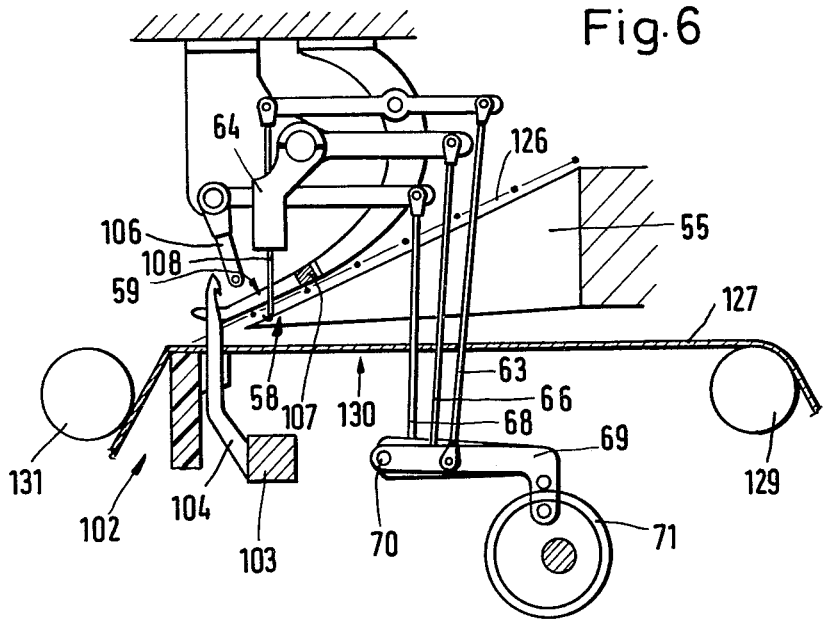

WARP KNITTING MACHINE WITH WEFT INSERTION MAGAZINE AND SUBSTRATE PROVISION ARRANGEMENT

BACKGROUND OF THE INVENTION

1. Field of the Invention

The present invention relates to warp knitting machines having a weft insertion magazine which lays weft threads in parallel across the entire breadth of the machine and also has a substrate providing arrangement wherein the plane of the substrate subtends an acute angle with the plane of the weft thread and is further provided with at least one boundary element, in particular, a hold down means on the side of the substrate path opposite to the needle bar.

2. Discussion of the Relevant Art

In known warp knitting machines of this type (DEOS No. 2,316,160) a weft thread path is provided on the side of the substrate path facing the needle bar. Between the weft thread path and the substrate path there is provided a barrier wall which permits the provision of the weft threads at a higher speed than the provision of the substrate, without one interfering with the other. On the side of the substrate opposite the needle bar there is provided as a barrier element, a hold-down means in the form of a support comb. Where the warp knitting machines are wide and/or operate at high working speeds, there is the danger that the weft threads will vibrate. This vibration can lead to an irregular knotting-off of the weft and substantial braking of the warp threads.

It is further known (DEPS No. 2,244,096) when utilizing a warp knitting machine equipped with a weft thread magazine but without a substrate provision arrangement, to provide forwarding means for the weft threads. These forwarding means are arranged on the same side of the weft thread path as the needle bar and can separate the first weft thread from the one following and transfer them to the rearward side of the needles.

Accordingly, there is a need for an improved warp knitting machine of the foregoing type which, despite the presence of the fabric substrate permits a trouble-free provision of weft threads.

SUMMARY OF THE INVENTION

A warp knitting machine according to the principles of the present invention can deliver weft threads and a substrate at a relative acute angle along a weft path and a separate, substrate path to a needle bed having a needle bar. The machine has a weft thread magazine and a substrate provider for delivering the substrate along the substrate path. The weft thread magazine can transversely lay weft threads across the breadth of the machine in parallel on the weft path upstream of the needle bed. The weft path and needle bar are on opposite sides of the substrate path. Also included is a holding means having at least one barrier aperture, for limiting the mobility along at least one of the paths. The holding means and needle bar are on opposite sides of the substrate path. The machine also has at least one forwarding means for protruding through the barrier aperture into the weft path and separating a leading one of the weft threads and bringing it to the downstream side of the needle bed.

By using the foregoing apparatus an improved warp knitting machine is obtained. In the preferred embodiment the weft thread path is provided on the side of the fabric substrate path away from the needle bar. A forwarding means intrudes into the weft thread path and separates each first weft thread from the following weft thread and moves it to the rearward side of the needles, an aperture being provided in a barrier element for the acceptance therethrough of each forwarding means. This barrier element can, for example, be provided between the substrate path and the weft thread path. It permits a separation between the substrate and the weft threads, the latter being fed at a higher rate. At the same time the barrier element can serve as a hold down means.

Alternatively or additionally a barrier element can be provided on the side of the fabric path opposite the weft thread path. Also, in this case the barrier element can serve as a hold down means.

In a very simple embodiment of the invention, it is provided that a barrier element formed as a hold down means comprises sinkers reaching to the needle bed and the aperture is provided by the omission of a sinker, in place of which a forwarding means constructed as a sinker is located. The forwarding means can thus take over the hold down function of the omitted sinker. It is advantageous for the forwarding means to run substantially parallel to the substrate path and is also displaceable in this direction. This provides a very space conserving arrangement.

BRIEF DESCRIPTION OF THE DRAWINGS

In order that the invention may be more fully understood, it will now be described, by way of example, with references to the accompanying drawings in which:

FIG. 2 is an enlarged side elevational view of the working area of FIG. 1 showing the forwarding means at the beginning of its weft thread-intercepting stroke;

FIG. 3 shows the forwarding means of FIG. 2 at the extreme end of its movement path;

FIG. 4 shows the arrangement of FIG. 3 with an alternate drive means for the forwarding arrangement;

FIG. 6 shows the embodiment of FIG. 5 but with the forwarding means moved downwardly.

DESCRIPTION OF THE PREFERRED EMBODIMENTS

Figure 1:
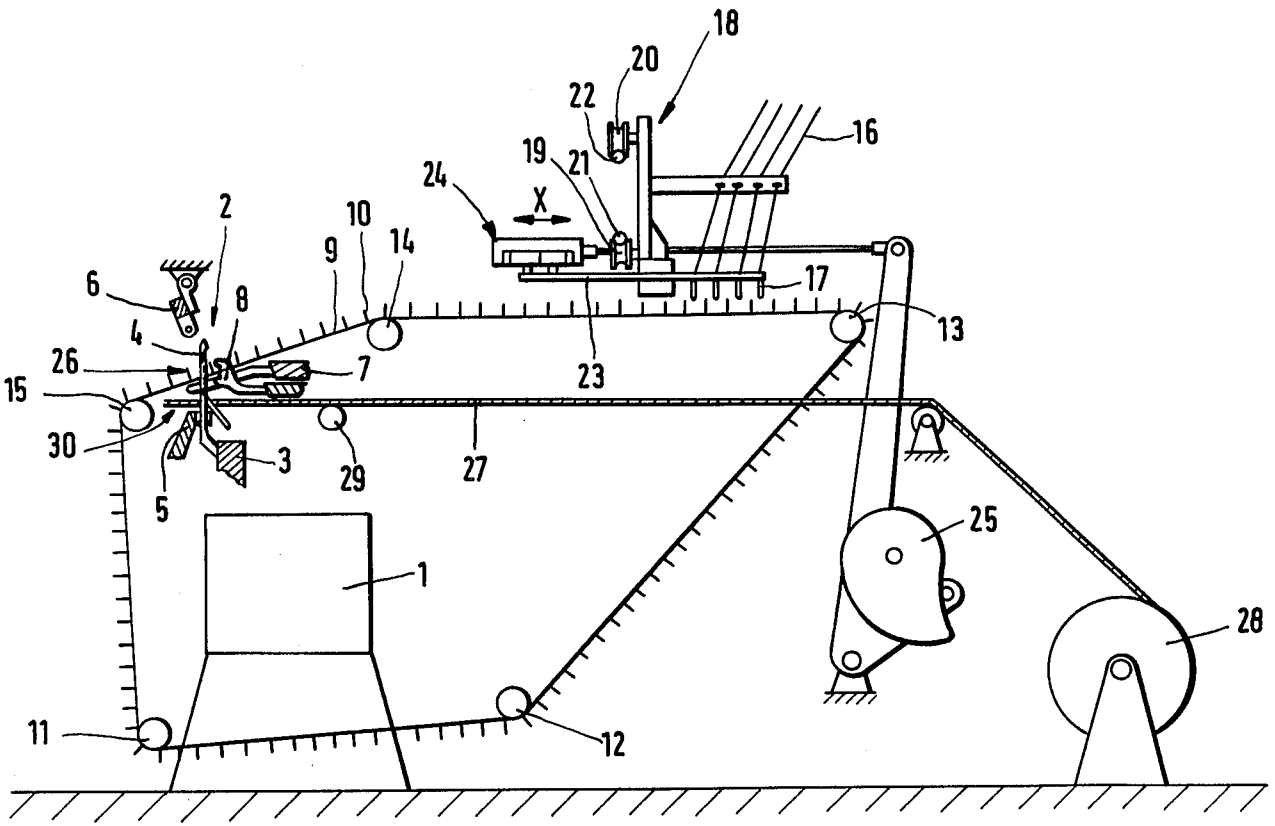
FIG. 1 is a schematic side view of a warp knitting machine having a weft thread magazine and a substrate providing arrangement, in accordance with the present invention.

FIG. 1 is a schematic representation of a warp knitting machine 1 whose working area 2 comprises needles 4 attached to needle bar 3 which is mounted to perform vertical reciprocation. Embracing needles 4 above bar 3 is dropper plate 5 operating as a knockover arrangement. A pivotally mounted guide bar 6 supports the usual warp thread guides, arranged to swing through needles 4. Extending through needles 4 is hold down means 7. A forwarding means 8 is also shown adjacent to the needles and is shown in further detail in FIGS. 2 and 3. A weft thread magazine comprises two parallel, spaced transport arrangements 9 in the form of endless chains which carry equally spaced, outwardly projecting holders 10. The transport arrangements 9 run counter-clockwise over chain wheels 11, 12, 13, 14 and 15 of which one is driven. Weft threads 16 may be laid in parallel from holding means 10 in one transport arrangement 9 by means of thread guides 17 to the other transport arrangement 9 and, after displacement in the counter-transport direction, are led back again. For this purpose there is employed carriage 18 which is transversely moveable back and forth perpendicular to transport arrangement 9 by means of rollers 19 and 20, rotatably mounted with their axes horizontal in vertically spaced positions in carriage 18. Rollers 19 and 20 run on spaced, parallel rails 21 and 22. Thread guides 17 are attached in a common vertical plane to bar 23, slidably mounted in carriage 18. Bar 23 is caused to experience an additional drive in the "X" direction by means of a steering arrangement 24 which is activated by cam plate 25. Steering arrangement 24 is a pair (one shown) of cowl-like devices mounted alongside chains 9 and spanned by metal band **24*a*. Band 24*a* is inserted between rollers 24*b*, which are mounted with their axes vertical on bar 23. Cam 25 is connected to rotate in proportion to the main shaft (not shown) of machine 1. Cam 25 can deflect lever 25*a* to longitudinally reciprocate rod 25*b*, steering arrangement 24, band 24*a* and rod 23**.

In working area 2, holders 10 move along and define weft path 26. There is further provided a substrate providing means for feeding the substrate 27 from a storage winding 28 by means of a drive roller 29. In working area 2 there is thus provided substrate path 30 alongside weft path 26 and at an acute angle thereto.

Referring to FIGS. 2 and 3, there is shown on opposite sides of needles 4, upstream roller 29 and downstream take-off roller 31 for allowing substrate 27 to pass over and under, respectively, the rollers, which each have horizontal axes of rotation. Hold down bar 32 is provided between and with its longitudinal axes parallel to the planes of weft thread path 26 and substrate path 30, which subtend in an acute angle to each other. To an intermediate portion 33 of bar 32 there are provided on one side thereof a hold down element 7 terminating in a plurality of spaced, parallel sinkers 34. Sinkers 34 are distributed to allow needles 4 to interdigitate therewith and are mounted parallel to weft path 26. Rotatably mounted on the underside of bar portion 33 is eccentric 38 which has eccentrically pivoted to its underside support swing 40. Rod 39, supporting forwarding means 8, is pivotally connected to lever 40 and has it upstream end attached to one end of angled lever 42 which is rotatably mounted about fixed axis 41. The other end of lever 42 is pivotally connected to and displaceable by upright rod 43, attached at its lower end to swingable lever 45 which is rotated about fixed axis 44 by the action of cam plate 46. Cam plate 46 engages the free end of lever 45 to rock it. Cam plate 46 is eccentrically mounted on drive shaft 47. Drive shaft 47 also drives eccentric 38 via chain 48. Forwarding means 8 are in the form of a plurality of members terminating in a reversed "C" shape, sized to engage weft threads 16. Forwarding means 8 can inter-leave with sinkers 34. Since only one or a few forwarding means 8 are necessary, corresponding gaps may be provided in the sinker element 34 without substantially influencing the barrier function provided by the latter. In particular, it is possible for forwarding means 8 to act as a hold down means in the area of the opening. Since forwarding means 8 is constructed in the form of a sinker which corresponds in strength to hold down sinker 34, it is sufficient to remove one of these sinkers 34 to provide a sufficient aperture 49 for the passage therethrough of forwarding means 8.

There is thus obtained the following mode of operation. Substrate 27 is continually fed in the direction of arrow "V" as shown in FIG. 2. The weft threads 16 are moved in the direction of arrow "S" at a higher speed. At each needle cycle the forwarding means 8 is brought behind the leading weft thread 16 in weft thread path 26 and moved forward until this weft thread is located downstream of needles 4 as shown in FIG. 3. Motion of rod 39 and forwarding means 8 are controlled by drive shaft 47 which drives lever 42 clockwise (through elements 45 and 43) and shifts eccentric 38 to adjust the upper end of lever 40. In the meantime, needles 4 have passed through the substrate and, utilizing a thread provided by thread guide 6, forms a stitch which attaches weft threads 16 to the upper side of substrate 27. Forwarding means 8 functions as a hold down means in the same way as sinkers 34 when the needle 4 penetrates the substrate. Needles 4 and forwarding means 8 then retract to complete the stitch cycle and return the machine to the initial conditions illustrated in FIG. 2. This form of construction makes it possible for forwarding means 8 to bring weft threads 16 into a position where they can be knotted off with certainty. Since the weft thread path 26 is not on the side of the substrate path 30 facing needle bar 3 but on the other side of the substrate path there is plenty of room for forwarding means 8 without necessitating the provision of a substantial separation of the knockover arrangements from the substrate path. Furthermore, it is possible to provide a new type of fabric in which the weft threads become more visible since now they are not held in place by needle stitches and thus covered with two threads but merely by sinker stitches.

From the foregoing it is apparent that it is possible to locate a bearing between substrate path 27 and the hold down bar 33 (provided to the weft thread path) and similarly a drive means, for at least one forwarding means. In particular it is possible to provide an eccentric drive between the hold down bar and the substrate path for which generally there is sufficient space. In addition, alternate drives are possible.

Referring to FIG. 4, an apparatus similar to that of FIGS. 2 and 3 has identical reference characters for identical components. Rod **39*a* supporting forwarding means 8 on its downstream end is slideably held in two bearings 40*a* on intermediate member 33*a*, parallel to substrate 27. Rod 39*a* is controlled by the peripheral shoulder of eccentric disc 50 which is carried by shaft 52 in bearing 51. Bearing 51 is mounted on the underside of bar 32. Shaft 52 is driven by drive shaft 53 over chain 54. The motion sequence here is similar to that of FIGS. 2 and 3 with the main difference that the forwarding means 8 is moved in a linear manner. Shaft 53 revolves in a manner similar to shaft 47 of FIG. 2**.

Figure 5:
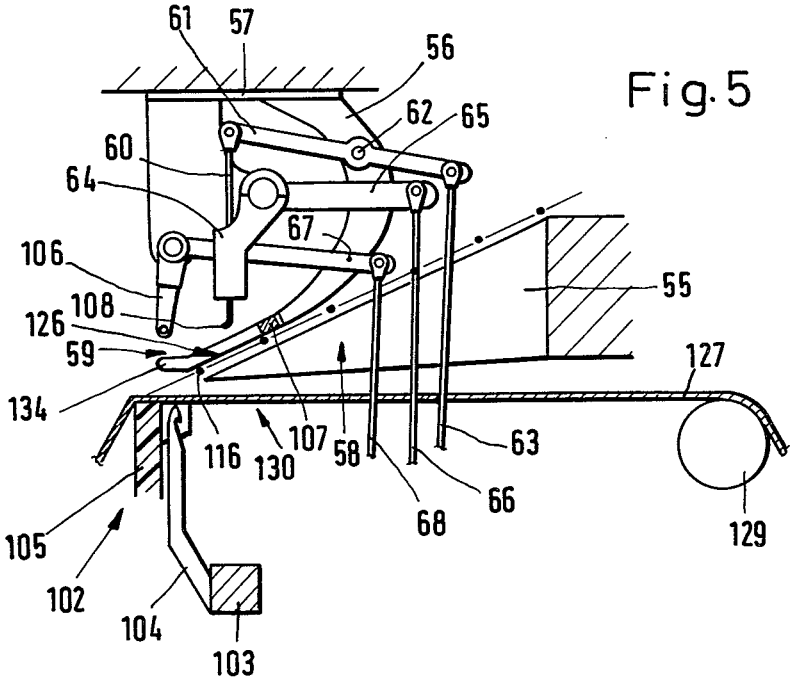
FIG. 5 is an enlarged side elevational view of another embodiment showing the forwarding means retracted at the beginning of its movement path.
Figure 7:
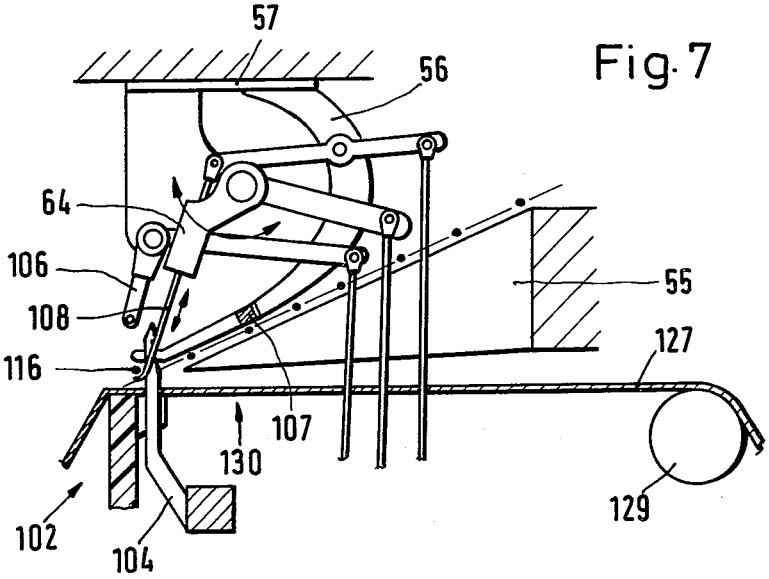
FIG. 7 shows the embodiment of FIG. 4 fully extended at the end of its movement path.

Referring to FIGS. 5, 6 and 7, corresponding components are shown in the 100 series relative to FIGS. 1 and 3 (e.g. 130 corresponds to 30).

In this embodiment two barrier elements are provided. The first barrier element is formed by a wedge-shaped, separating wall 55 which is located between weft thread path 126 and substrate path 130. Parallel to the plane of these two paths is hold down bar 107, acting as a second barrier element, together with the corresponding sinkers 134 mounted thereon. Bar 107 is secured to yoke 56 which is carried by head portion 57 of the warp knitting machine. Weft thread path 126 runs between the two barrier elements, that is to say, between separating wall 55 (provided between weft path 126 and substrate path 130) and the hold down means 107. In both barrier elements 55 and 107 apertures 58 and 59, respectively, are provided for the forwarding means to be described presently. In this manner weft threads 116 are led in a very safe manner. Despite the presence of two barrier elements there is plenty of space for the forwarding means. In the case where sinkers 134 are a plurality of evenly spaced, parallel tongs, the aperture can be formed by eliminating several separate ones of the series of sinkers.

Forwarding means 108 comprises a shaft 60 pivotally attached to one end of raising arrangement 61. This raising arrangement 61 comprises a rocking lever which is displaceable about fixed axis 62 in yoke 56 by means of upright rod 63 reciprocating vertically in accordance with the machine cycle. The shaft 60 can slide through swinging means 64, a collar driven by lever 65 according to the machine cycle by means of push rod 66. Push rod 66 is vertically reciprocated and is connected at its upper end to the outer end of lever 65. Lever 65 and collar 64 are both mounted on common axle **65*a* to bracket 56*a*, supported by head plate 57. In this embodiment, forwarding means 108 runs substantially perpendicular to substrate path 130 and is displaceable in such a manner that although its operating end is moved substantially perpendicular to the substrate path it is also movable substantially parallel thereto. This can occur in particular in that steerable raising arrangement 61 and a steerable swinging arrangement 64 is provided. That is to say, that the raisable and lowerable forwarding means 108 can carry out a swinging movement corresponding to that of a guide bar. The foregoing control is similar to that of guide bar 106 which is also controlled by a lever 67, vertically thrust at its free end by push rod 68. Lever 67 and guide bar 106 are both attached to shaft 67*a* journalled in bracket 56*a***.

Push rods 63, 66 and 68 are reciprocated by similar arrangements, the one for rod 63 being clearly shown in FIG. 6. The "L" shaped lever 69 is at one end rotatable about fixed axis 70 and at its other end is displaced by cam plate 71. Cam plate 71 is eccentrically rotated at an angular speed proportional to the cycling rate of machine 1 (FIG. 1). Rods 66 and 68 have similar levers and cam plates, hidden from view in FIG. 6, which reciprocate the rods at a rate and phase as described hereinafter.

During operation of the system, substrate 127 and weft threads 116 are transported to working area 102. Rod 60 of forwarding means 108 is moved downwardly through apertures 58 and 59 by rotating raising arrangement 61 counterclockwise from the position of FIG. 5 to that of FIG. 6. Then by means of swinging arrangement 64 forwarding means 108 is swung forwardly (FIG. 7). This swinging movement operates counter to that of guide bar 106. Then the raising arrangement 61 is activated in the opposite direction and a rearward swing comes into affect so that again the position of FIG. 5 is achieved.

It will be understood that various changes in the details, materials, arrangement of parts and operating conditions which have been herein described and illustrated in order to explain the nature of the invention may be made by those skilled in the art within the principles and scope of the instant invention.

Having thus set forth the nature of the invention, what is claimed is:

1. A warp knitting machine for delivering weft threads and a substrate at a relative acute angle along a weft path and a separate, substrate path to a needle bed having a needle bar, said machine comprising:

a weft thread magazine for transversely laying said weft threads across the breadth of said machine in parallel on said weft path, upstream of said needle bed, said weft path and needle bar being on opposite sides of said substrate path;

a substrate providing means for delivering said substrate along said substrate path;

a holding means, having at least one barrier aperture, for limiting the mobility along at least one of said paths, said holding means and needle bar being on opposite sides of said substrate path; and at least one forwarding means for protruding through said barrier aperture into said weft path and separating a leading one of said weft threads and bringing it to the downstream side of said needle bed.

2. A warp knitting machine according to claim 1 wherein said holding means comprises:

a barrier element mounted between said substrate and weft path.

3. A warp knitting machine according to claim 2 wherein said barrier element and substrate path are located on opposite sides of said weft path.

4. A warp knitting machine according to claim 1 wherein said holding means comprises:

a plurality of spaced knock-over sinkers mounted proximate to said needle bed and over said substrate to limit its mobility, said sinkers having a substantially even distribution except for an omission therein forming said barrier aperture.

5. A warp knitting machine according to claim 4 wherein said forwarding means has a forward end that protrudes through said barrier aperture proximate to said needle bed, said forward end being shaped and positioned to perform a knocking-over operation at said needle bed.

6. A warp knitting machine according to claim 4 wherein said forwarding means extends in a direction parallel to said substrate and is operable to reciprocate in a direction parallel to said substrate.

7. A warp knitting machine according to claim 6 wherein said holding means comprises:

a hold down bar for supporting said sinkers, said hold down bar being disposed between said substrate and weft path; and a bearing mounted on said hold down bar for supporting said forwarding means and allowing it to reciprocate, said machine further comprising:

a drive means mounted on said hold down bar for reciprocating said forwarding means.

8. A warp knitting machine according to claim 7 wherein said drive means comprises:

an eccentric element rotatably mounted on said hold down bar at a position between the latter and said substrate path.

9. A warp knitting machine according to claim 1 wherein said forwarding means extends transversely toward said substrate path, terminating in an outer end, said outer end being reciprocatable with two degrees of freedom to allow motion substantially transverse and parallel to said substrate path.

10. A warp knitting machine according to claim 9 wherein said forwarding means comprises:

a forwarding element;

a raising element for pivotally supporting said forwarding element and for lifting it; and swinging means for swinging said forwarding element.

11. A warp knitting machine according to claim 10 wherein said holding means comprises:

a separating wall mounted between said substrate path and weft path; and a hold down element mounted on the side of said weft path opposite to that of said separating wall.

* * * * *